US005139534A

United States Patent [19]

Tomassen et al.

[11] Patent Number: 5,139,534

[45] Date of Patent: Aug. 18, 1992

[54] DIESEL FUEL ADDITIVES

[75] Inventors: Henricus P. M. Tomassen; Madelinde G. F. M. van Grieken, both of Amsterdam, Netherlands; Keith Reading, Upton, England

[73] Assignee: Shell Oil Company, Houston, Tex.

[21] Appl. No.: 670,818

[22] Filed: Mar. 18, 1991

[30] Foreign Application Priority Data

Apr. 3, 1990 [GB] United Kingdom ..... 9007431

[51] Int. Cl.[5] ..... C10L 1/24; C10L 1/22

[52] U.S. Cl. ..... 44/418; 44/412

[58] Field of Search ..... 44/418, 412

[56] References Cited

U.S. PATENT DOCUMENTS

| | | | |
|---|---|---|---|
| 2,456,569 | 12/1948 | Smith | 44/57 |
| 2,684,292 | 7/1954 | Caron et al. | 44/68 |
| 3,021,238 | 2/1962 | Mahan | 44/412 |
| 3,707,362 | 12/1972 | Zimmerman | 44/412 |
| 3,982,909 | 9/1976 | Hollyday | 44/418 |
| 4,208,190 | 6/1980 | Malec | 44/53 |
| 4,482,357 | 11/1984 | Hanlon | 44/63 |
| 4,509,952 | 4/1985 | Braxton | 44/57 |
| 4,832,702 | 5/1989 | Kummer et al. | 44/412 |

FOREIGN PATENT DOCUMENTS

| | | |
|---|---|---|
| 659210 | 4/1938 | Fed. Rep. of Germany . |
| 960920 | 3/1957 | Fed. Rep. of Germany . |
| 1221034 | 5/1960 | France . |
| 2403381 | 5/1979 | France . |

*Primary Examiner*—Brian E. Hearn
*Assistant Examiner*—M. Nuzzolillo

[57] ABSTRACT

The invention provides a diesel fuel additive for reducing fouling of injectors in diesel engines consisting of at least an effective concentration of a nitrogen-containing compound of general formula $$CH_3(CH_2)_n—A—NH_2 \quad (I)$$

wherein n is 4 to 18 and A is —$CH_2$— or —CO—, or a mixture thereof as an additive in a diesel fuel comprising a major proportion of a diesel oil and a method for using said additive.

10 Claims, No Drawings

DIESEL FUEL ADDITIVES

BACKGROUND OF THE INVENTION

1. Field of the Invention

This invention relates to diesel fuel additives, and more particularly to a composition of certain nitrogen-containing compounds and a method of its use in diesel fuel to impart improved properties.

2. Description of the Related Art

W. German Patent Application S 34337 IVC/23b (DE OS 960,920) (Socony Mobil Oil Company) describes certain distilled fuels containing linear aliphatic primary monoamines having 7 to 18 carbon atoms per molecule. These fuels may be fuel oils, gasoline, etc., e.g. heating oils or diesel oils. Such oils are described as having a tendency on storage to form precipitates or sludge and hence to block sieves or filters, and the reason for including the above monoamines in them is to prevent the blockage of sieves or filters. Tests described in the examples employ an oil having a boiling range between 160° and 340° C., and 75 g per cubic meter of amine, pumped through a 100-mesh Monelmetal sieve. The amines illustrated include octylamine, decylamine, dodecylamine, tetradecylamine, hexadecylamine, octadecylamine and various mixtures of amines.

German Patent 659,210 (I.G. Farbenindustrie) discloses motor fuel, e.g. benzole, gasoline, containing water-insoluble aliphatic or aliphatic-aromatic amines having a straight chain of atoms, as corrosion inhibitors against the effects of sulphuric acid produced in the engine from organic sulphur impurities in the fuel. Although n-octylamine, dodecylamine and octadecylamine are specifically named, the sole example comprises 100 parts by weight of gasoline together with 1 part by weight of dimethyldodecylamine.

U.S. Pat. No. 4,509,952 (filed Apr. 1, 1981), assigned to Ethyl Corporation, discloses fuel oil compositions comprising furnace oil or diesel oil and alkyldimethylamine (a $C_{4-20}$ n-alkyl dimethylamine, preferably a $C_{8-14}$ n-alkyl dimethylamine) wherein the amine is included in order to stabilise the oil against deterioration, e.g. colour deterioration, sludge formation, filter plugging, emulsification and rusting of storage containers. N,N-dimethyl dodecylamine is sold by Ethyl Corporation under trade mark "ADMA 12".

U.S. Pat. No. 3,707,362 (filed Dec. 26, 1972), assigned to Esso Research and Engineering, discloses fuel, particularly gasoline, consisting of a major proportion of volatile hydrocarbons and a minor proportion of a tertiary aliphatic amine with a $C_{12-20}$ n-alkyl substituent and two $C_{1-3}$ alkyl substituents, preferably together with a $C_{12-20}$ n-alkyl primary amine. The amine/amine mixture is stated to improve the distribution of air-fuel mixture in the induction system, and hence to the cylinders, of an internal combustion engine and to reduce the tendency of a film of liquid to form on the walls of the inlet manifold of the engine. Tests and comparative tests describe use of gasolines containing, variously, tertiary amines, primary amines and mixtures of such amines.

U.S. Pat. No. 4,482,357 (filed Dec. 30, 1983), assigned to Ethyl Corporation, discloses a distillate fuel for indirect compression ignition (diesel) engines which includes (i) a hydrocarbyl-substituted succinimide or succinamide, (ii) a $C_{8-60}$, $N_{1-10}$ hydrocarbyl amine, and (iii) N,N'-disalicylidene-1,2-diaminopropane. The combination of additives (i) to (iii) is stated to minimize coking on the injector nozzles. In the combination of additives (i) to (iii), (ii) is preferably a $C_{8-18}$, more preferably $C_{12-16}$, tertiary-alkyl primary amine.

It has now surprisingly been found that use of certain nitrogen-containing compounds in diesel fuel per se reduces fouling of injectors in diesel engines. This reduced fouling is an entirely different technological effect from the prevention of blockage of sieves or filters described in DE OS 960,920 discussed above, since the diesel fuel reaching the cylinders of a diesel engine will already have passed a fine filter, and the fouling of injectors is induced by the high temperatures to which the injectors are exposed in operation of the engine.

SUMMARY OF THE INVENTION

According to the present invention there is provided a method for reducing fouling of injectors, particularly injector nozzles, comprising combusting in a diesel engine an effective concentration of a nitrogen-containing compound of general formula $$CH_3(CH_2)_n\text{-}A\text{-}NH_2 \qquad (I)$$

wherein n is 4 to 18 and A is —$CH_2$— or —CO—, or a mixture thereof as an additive in a diesel fuel comprising a major proportion of a diesel oil, and a diesel fuel additive composition as described in the method above.

DESCRIPTION OF THE PREFERRED EMBODIMENT(S)

Diesel oils are well known, and whilst different countries have different specifications, to suit climate, etc. (e.g. in UK, BS 2869), diesel oils generally have boiling ranges in the range 120° C. to 370° C., with initial boiling point in the lower region of such range and final boiling point in the upper region, and 50% distillation occurring at a temperature in the range 235° C. to 295° C. Density of diesel oils tends to be in the range 0.82 to 0.86 kg/dm$^3$ at 20° C.

Effective concentrations of the compounds of formula I may generally be expected to be in the range 10 to 500 ppmw (parts per million by weight of the diesel fuel). Preferably the concentration is in the range 20 to 100 ppmw, e.g. 30 to 80 ppmw.

In formula I, n is preferably 6 to 16, more preferably 8 to 12. Compounds of formula I wherein n is 10 have been found to be very effective. A in formula I is preferably —$CH_2$—. Dodecylamine is a particularly preferred compound of formula I. The additive may be placed in admixture with a diesel oil wherein the additive may comprise a major (greater than 50% wt) or minor portion.

The invention also provides a method of operating a diesel engine with reduced fouling of injectors which comprises running the engine on a diesel fuel containing a major proportion of a diesel oil and an effective concentration of a nitrogen-containing compound of formula I as defined above.

The ranges and limitations provided in the instant specification and claims are those which are believed to particularly point out and distinctly claim the instant invention. It is, however, understood that other ranges and limitations that perform substantially the same function in substantially the same way to obtain substantially the same result are intended to be within the scope of the instant invention as defined by the instant specification and claims.

EXAMPLE(S)

The invention will be described by the following example(s) which are provided for illustrative purposes and are not to be construed as limiting the invention:

EXAMPLES 1 and 2

Engine tests were performed on a selection of diesel fuels all of which were based on a blended diesel oil (without additives) in accordance with BS 2869, having cetane value in the range 50 to 53 (base oil). Example 1 was a solution of 38 ppmw (parts per million by weight of the diesel fuel) dodecylamine (laurylamine) in the base oil. Example 2 was a solution of 38 ppmw dodecanamide (lauramide) in the base oil. Comparative A was the base oil itself, Comparative B was a solution of 38 ppmw N,N-dimethyl dodecylamine in the base oil, and Comparative C was a solution of 38 ppmw "OXILUBE 40/40" (trade mark) copolymer in the base oil. "OXILUBE 40/40" copolymer is a copolymer of ethylene oxide and propylene oxide containing 40% w propylene oxide, of specific gravity at 20° C. 0.98 (ASTM D.1298) and viscosity at 40° C. 33 mPa (cSt) (ASTM D.445), available from member companies of the Royal Dutch/Shell Group.

The above fuels were all tested according to the following method, employing a Fiat IDI (indirect injection) 1929 cc, type 149 A1.000, diesel engine as used in Fiat Regata diesel automobiles.

The engine was warmed up according to the following programme:

| Engine speed (rpm)/dynamometer load (Nm) | Time (mins) |
|---|---|
| 1200/25 | 1 |
| 1200/40 | 2 |
| 1800/50 | 2 |
| 1800/60 | 2 |
| 2000/60 | 2 |
| 2000/75 | 2 |

The engine was then run at 2700 rpm and 75 Nm for 8.5 hours, after which engine speed/load was quickly reduced to 1500 rpm/25 Nm and the engine was switched off. Coolant oil/water temperatures were maintained at 90±2° C.

Performance of each diesel fuel was assessed quantitatively by air-flow measurement of fouling levels produced in the engine's injector nozzles. The nozzles, of type Bosch DN 12 SD 1750, were placed in a Ricardo air-flow rig according to ISO 4010, and air-flow measurements were recorded at needle lifts of 0.1, 0.2 and 0.3 mm, with a vacuum pressure 600 m Bar (60,000 Pa).

Build-up of deposits in the nozzles causes a reduction in measured air-flow, and degree of nozzle fouling can be quantified by the formula $$\text{Nozzle Fouling} = \frac{\text{Flow (clean)} - \text{Flow (fouled)}}{\text{Flow (clean)}} \times 100$$

where "clean" values were measured prior to engine test and "fouled" values were measured after engine test.

Average fouling levels (averages of values at the three needle lift levels) were as follows:

| Fuel (Example) | Fouling level (%) |
|---|---|
| 1 | less than 10% |
| 2 | 25 to 35% |
| Comparative A | 55 to 65% |
| Comparative B | 67% |
| Comparative C | 65% |

What is claimed is:

1. A diesel fuel composition for reducing fouling of injectors in diesel engines consisting essentially of a major portion of a hydrocarbon base fuel of the diesel fuel boiling range and a nitrogen-containing additive of general formula $$CH_3(CH_2)_n\text{-A-}NH_2 \quad (I)$$

where n is 8 to 12 and A is —$CH_2$—, wherein said additive comprises 10 to 500 ppmw of the diesel fuel.

2. A diesel fuel composition for reducing fouling of injectors in diesel engines comprising a major portion of a hydrocarbon base fuel of the diesel fuel boiling range and a nitrogen-containing additive of general formula $$CH_3(CH_2)_n\text{-A-}NH_2 \quad (I)$$

where n is 4 to 18 and A is —CO—, wherein said additive comprises 10 to 500 ppmw of the diesel fuel.

3. The diesel fuel additive according to claim 2 wherein n in formula I is 6 to 16.

4. The diesel fuel additive according to claim 2 wherein n is 8 to 12.

5. The diesel fuel additive according claim 2 wherein the compound of formula I is dodecylamide.

6. A formulation composition comprising a major portion of diesel oil in admixture with a minor portion of a diesel fuel additive as described in claim 2.

7. The formulation according to claim 6 wherein the compound of formula I comprises 20 to 100 ppmw of the diesel fuel.

8. A concentrate composition comprising a minor portion of diesel oil in admixture with a major portion of a diesel fuel additive as described in claim 2.

9. A method for reducing the fouling of injectors in diesel engines which comprises combusting in the engines a diesel fuel composition consisting essentially of a major portion of a diesel oil and 10 to 500 ppmw of the diesel fuel of the nitrogen-containing additive as recited in claim 1.

10. A method for reducing fouling of injectors in diesel engines which comprises combusting in the engines a diesel fuel composition containing a major portion of a diesel oil and 10 to 500 ppmw of the diesel fuel of a nitrogen-containing additive compound of general formula I as defined in claim 2.

* * * * *